US011232691B2

(12) United States Patent
Napiorkowski

(10) Patent No.: US 11,232,691 B2
(45) Date of Patent: Jan. 25, 2022

(54) BABY MONITOR ASSEMBLY

(71) Applicant: Stanislaw Napiorkowski, Warsaw (PL)

(72) Inventor: Stanislaw Napiorkowski, Warsaw (PL)

( * ) Notice: Subject to any disclaimer, the term of this patent is extended or adjusted under 35 U.S.C. 154(b) by 0 days.

(21) Appl. No.: 16/975,180

(22) PCT Filed: Feb. 8, 2019

(86) PCT No.: PCT/EP2019/053198

§ 371 (c)(1),
(2) Date: Aug. 24, 2020

(87) PCT Pub. No.: WO2019/162113

PCT Pub. Date: Aug. 29, 2019

(65) Prior Publication Data

US 2021/0118277 A1 Apr. 22, 2021

(30) Foreign Application Priority Data

Feb. 23, 2018 (EP) ..... 18461521

(51) Int. Cl.

| | |
|---|---|
| ***G08B 21/02*** | (2006.01) |
| ***F21V 9/00*** | (2018.01) |
| ***F21V 23/04*** | (2006.01) |
| ***G08B 7/06*** | (2006.01) |
| *F21Y 113/13* | (2016.01) |
| *F21Y 115/10* | (2016.01) |

(52) U.S. Cl.

CPC ..... *G08B 21/0205* (2013.01); *F21V 9/00* (2013.01); *F21V 23/0442* (2013.01); *G08B 7/06* (2013.01); *G08B 21/0277* (2013.01); *F21Y 2113/13* (2016.08); *F21Y 2115/10* (2016.08)

(58) Field of Classification Search

CPC ..... G08B 21/0205; G08B 7/06; F21V 9/00; F21V 23/0442

USPC ..... 340/539.1

See application file for complete search history.

(56) References Cited

U.S. PATENT DOCUMENTS 6,476,724 B1 * 11/2002 Slomowitz ..... G08B 21/0208 340/539.1

2004/0061607 A1 * 4/2004 Pargman ..... G08B 1/08 340/539.15

(Continued)

FOREIGN PATENT DOCUMENTS

EP 2976998 A1 1/2016

*Primary Examiner* — Kerri L McNally

(74) *Attorney, Agent, or Firm* — Dickinson Wright PLLC; Andrew D. Dorisio

(57) ABSTRACT

A baby monitor assembly includes an emitter unit and a receiver unit, wherein the emitter unit includes means for sound detection, such as a microphone, means for communication with the receiver unit, a generally flat housing, having a peripheral slit, and a source of light. The receiver unit includes means for communication with the emitter unit, and signalizing means. The emitter unit is suitable and configured for placing under a crib, and is capable of detecting sounds and sending information to the receiver unit upon detection of predetermined type of noise. The receiver unit is configured for receiving information from the emitter unit and notifying the parent, such as using light, sound or vibration signals. A slit in the housing allows for emitting a light beam selectively essentially parallel to the floor, so that it neither shines directly nor reflects into the eyes of the baby and the user.

15 Claims, 7 Drawing Sheets

(56) References Cited

U.S. PATENT DOCUMENTS

Figure 1:
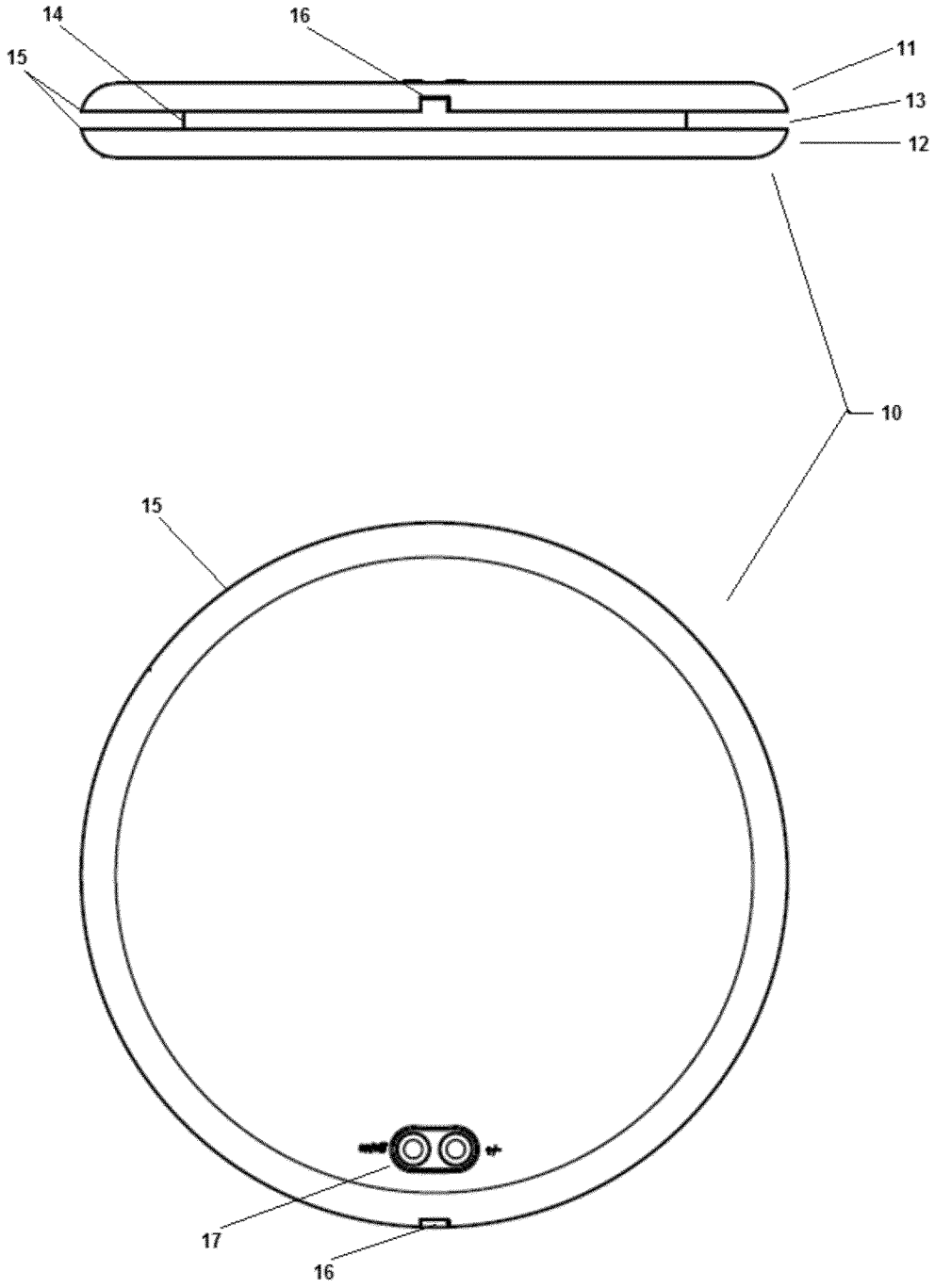

| | | | | |
|---|---|---|---|---|
| 2011/0144455 | A1* | 6/2011 | Young | A61B 5/11 600/301 |
| 2012/0169502 | A1* | 7/2012 | Huang | A61B 5/11 340/573.1 |
| 2015/0157224 | A1* | 6/2015 | Carmon | A61B 5/165 600/479 |
| 2016/0183695 | A1 | 6/2016 | Veron | |
| 2018/0047273 | A1* | 2/2018 | Dejong | G08B 21/0277 |

* cited by examiner

BABY MONITOR ASSEMBLY

TECHNICAL FIELD

The invention is related to baby monitor systems that help parents complete daily chores in their home while keeping an eye on the baby.

BACKGROUND OF THE INVENTION

Usually, there are two main types of baby monitors available nowadays—the first is the type that is concentrated on sounds. Its role is to detect noise generated by the baby—its cry, cough, movement etc. and notify parent (the user) about the noise, usually with the option of transmitting the exact sounds from around the baby, so that the parent can listen and decide whether the baby needs attention, the example of such device may be VTech Safe & Sound baby monitor. Such devices are relatively simple in construction, but beside transmitting sounds from the baby and optional talking back via the device to the baby, its features are limited. The parent still has to come to the baby's room to check on the baby, and if it is during nighttime—the parent needs a source of light so as not to step on toys etc., that may be lying on the floor. This is very inconvenient, because too much light may wake up a sleepy baby, which will bring the need of putting the baby to sleep again.

The second type of baby monitors additionally uses a camera and a source of light. Baby monitors of this type can record and transmit video of what is happening in the baby's room. For use in the night they usually have built-in lamps/diodes. Chinese document CN201417493Y describes such a device, that has both audio and video recording means. Unfortunately, such baby monitor is either using infrared lights and camera, and therefore is expensive, or normal lights and normal camera, which is very risky, as too much light might easily wake up the baby.

Any of the known baby monitors equipped with light sources have these light sources for only one reason: to enlight the baby's room for the sake of video transmission from the emitting station (emitter unit, baby nanny), placed in the baby room to the receiving station (receiver unit, parent nanny), placed in the parents' room. These devices are therefore never intended for placing them below a baby's bed and even if they fit there—no one would contemplate placing them in such a location, because of the assumed video transmission.

In the state of art there are also devices known that serve as a help during nighttime by illuminating the floor, so that if the person needs e.g. to go to the bathroom any possible obstacles, cupboards etc. will be visible, but at the same time—the light won't be strong enough to wake up another person. The example of such a device is an underbed HaloNight light. This lamp is plugged to the wall and softly illuminates across the floor during the night. It is disc-like shaped, to fit under many different pieces of furniture and is equipped with LEDs around it's periphery. This device can help to avoid obstacles while walking at night, but even while being placed under the bed, its light can reflect from the surfaces and inconveniently shine directly into the eyes of someone lying in the bed, be it adult or a child.

From US2005078481 there is also known a device that softly illuminates objects at night, that are located at or near the device. It is provided with movement detection means and light sensors. When e.g. a person is trying to find glasses at night, the device will detect the approaching hand and start illuminating, to act as a beacon. The device also detects light intensity in its vicinity, so that it only will illuminate when it is dark. Such a device can help a lot with finding everyday objects during nighttime, but it may still shine directly into user's eyes, and it is not suitable for use as a baby monitor.

SUMMARY OF THE INVENTION

Other lighting devices, in particular lamps are known, which are activated by various sensors, such as sound sensor, light intensity sensor, motion detector etc., but they are missing the functionality of a baby monitor.

All of the aforementioned devices have drawbacks, as they cannot be used as a baby monitor, that will also help the user to navigate around the room at night, without shining directly into the user's eyes and without the risk of waking up the baby due to excessive lightning.

The present invention solves this problem, by providing a device that can be placed under the baby's bed/crib so as not to be obstructive in everyday life and can serve both as a baby monitor and a night light, that will only illuminate the objects lying on the floor and will minimize the amount of light that can access the user's or the baby's eyes.

A baby monitor assembly, comprising an emitter unit and a receiver unit, wherein the emitter unit comprises:

- means for sound detection, preferably a microphone,
- means for communication with the receiver unit, preferably means for wireless communication, especially via WiFi, Bluetooth or Radio,
- a generally flat housing, having a slit near it's periphery,
- a source of light, preferably LED diodes, wherein the receiver unit comprises:

- means for communication with the emitter unit, preferably means for wireless communication, especially via WiFi, Bluetooth or Radio,
- signalizing means, preferably suitable for emitting light, sound or vibration signals wherein the emitter unit is suitable and configured for placing under baby's crib, bed or the like, and is capable of detecting sounds generated by the baby, and sending information to the receiver unit upon detection of predetermined type of noise, wherein the receiver unit is suitable and configured for receiving information from the emitter unit and notifying the parent, preferably by using light, sound or vibration signals, upon receiving information from the emitter unit, characterized in that the slit in the emitter unit's housing allows for passage of light from the source of light located in the housing, and is configured for emitting the light beam selectively essentially parallel to the floor, so that the light beam neither shines directly nor reflects into the eyes of the baby and the user.

Preferably, the baby monitor assembly is configured so that the emitter unit powers up upon first detection of a predetermined type of noise and waits for the second detection of the predetermined type of noise within a predetermined time interval from the first detection, and only upon such second detection within the predetermined time interval from first detection—the emitter unit sends information to the receiver unit to notify the parent and starts generating light through the slit.

Preferably, the emitter unit is provided with a filter of light to filter out spectrum of a blue light from the light it emits, preferably to filter out the light of wavelength between 450 and 500 nm.

Preferably, the emitter unit further comprises attaching means for attaching the emitter unit to the underside of the bed/crib.

Preferably, the emitter unit is configured to gradually rise or reduce light intensity, according to user's preferences.

Preferably, inside the emitter unit there is a set of colorful light sources, preferably LEDs of different colors, that can be programmed to emit light of a preferred color and/or with a preferred sequence.

Preferably, the received unit has a speaker and the emitter unit is capable of transmitting sounds detected by the microphone to the receiver unit to be played by the receiver unit to the user, preferably via said speaker.

Preferably, the receiver unit is further provided with sound recording means, preferably a microphone, and the receiver unit is suitable and configured for transmitting sounds recorded by the receiver unit's sound recording means to the emitter unit, and the emitter unit is further provided with a speaker and is suitable and configured for emitting sounds received from the receiver unit.

Preferably, the receiver unit is configured such that transmission of sound from the receiver unit to the emitter unit occurs only upon user direct interaction with the receiver unit, preferably using a button, switch or with a voice command.

Preferably, the emitter unit further comprises a motion sensor and/or a light intensity sensor.

Preferably, the emitter unit and/or the receiver unit are provided with internal power source, preferably a battery or with socket for connecting to an external power source, or more preferably with both the internal power source and socket for connecting to the external power source.

Preferably, the housing of the emitter unit and/or of the receiver unit has a disk-like shape, with substantially flat top and bottom surfaces.

Preferably, a single lens or a set of lenses is located in the housing, preferably near the slit, for shaping the light beam.

In one preferred embodiment, the emitter unit and the receiver unit are identical devices.

In another preferred embodiment, the receiver unit is a smartphone or a tablet.

The invention will be now described with reference to the attached drawings in which:

BRIEF DESCRIPTION OF THE DRAWING FIGURES

Figure 2:
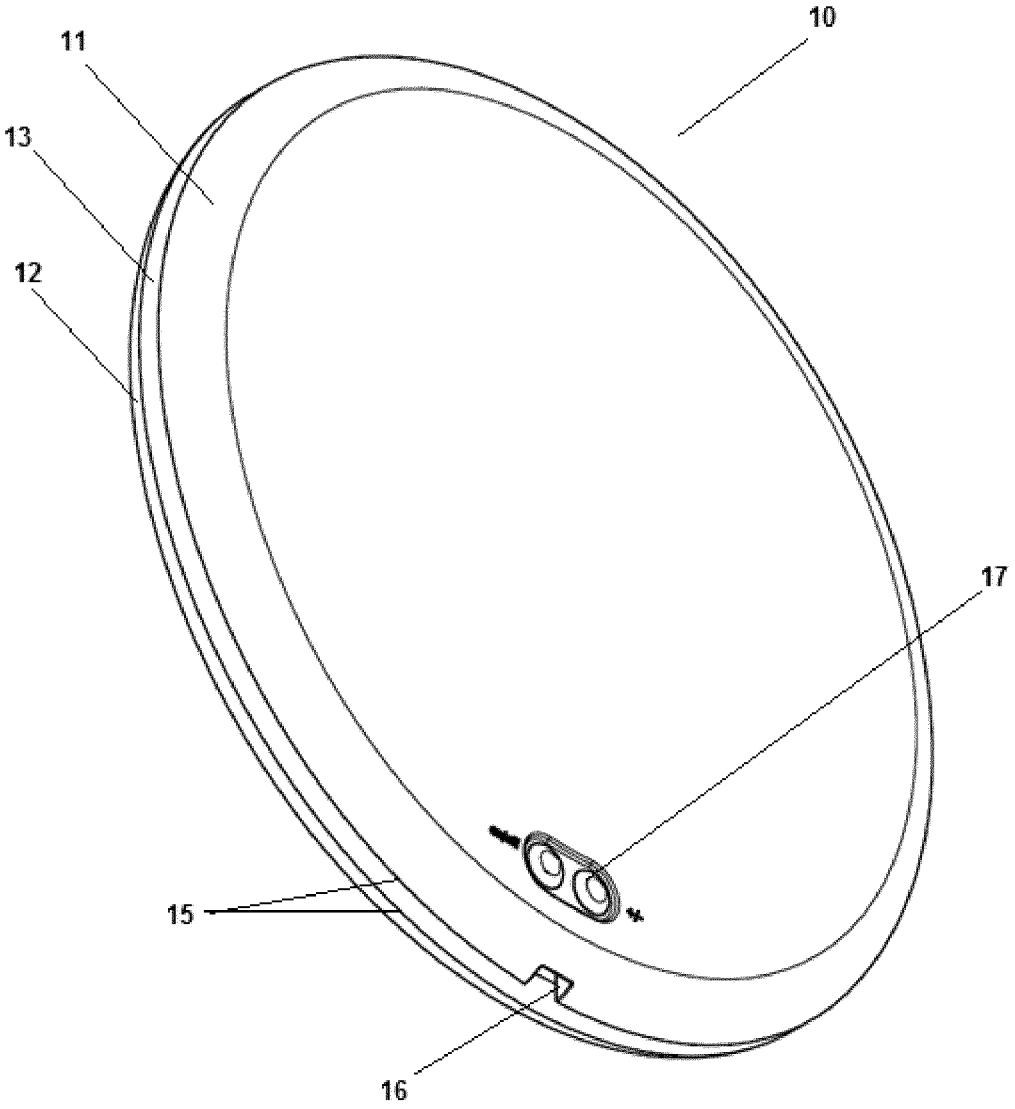
Figure 3:
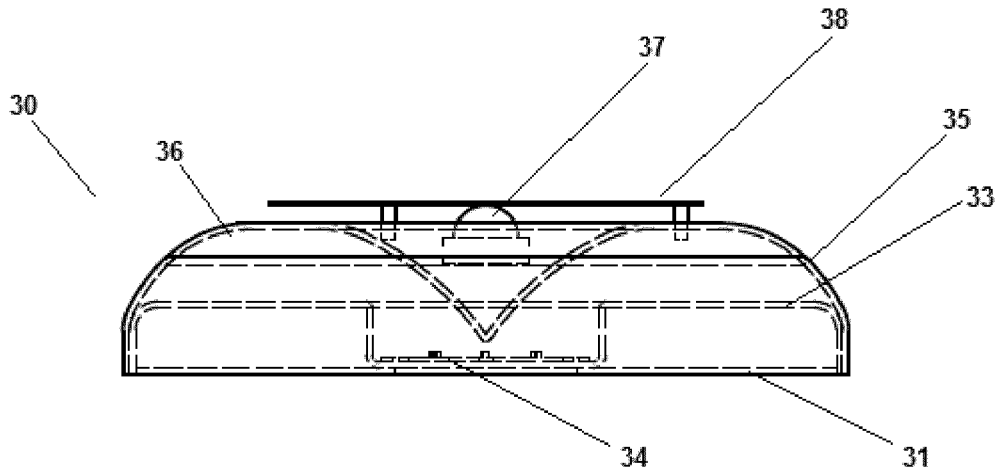
Figure 3:
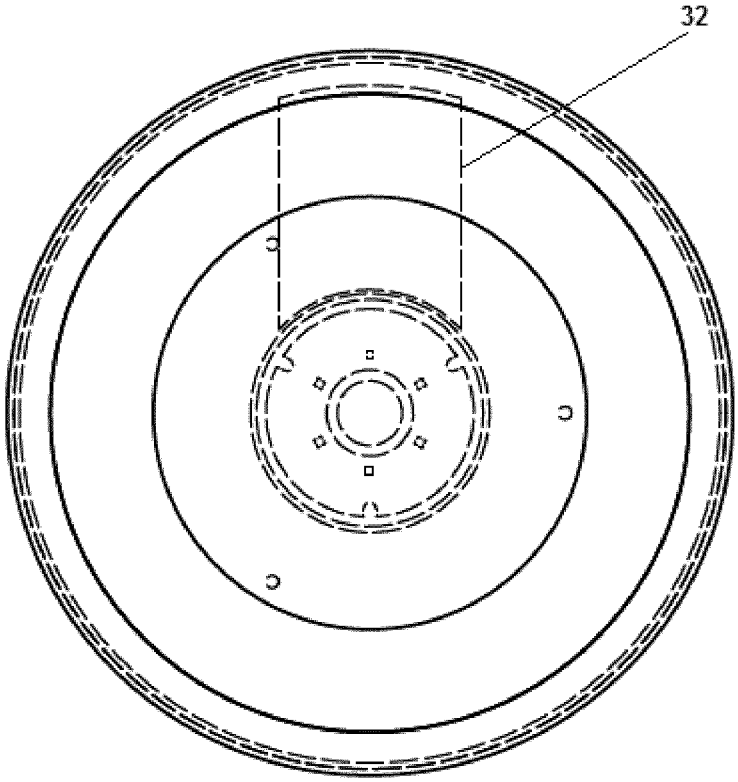
Figure 4:
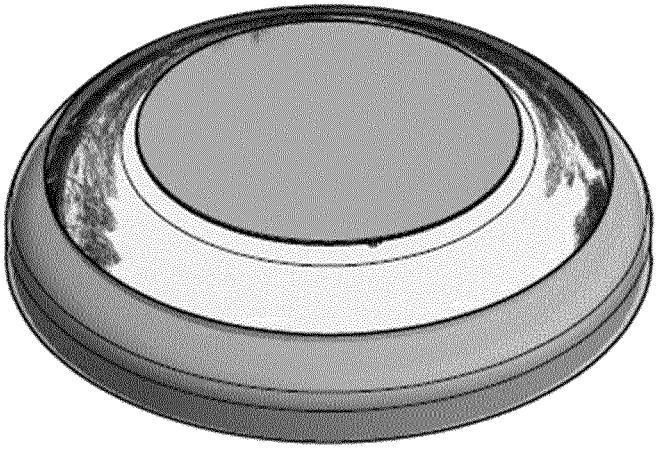
Figure 5:
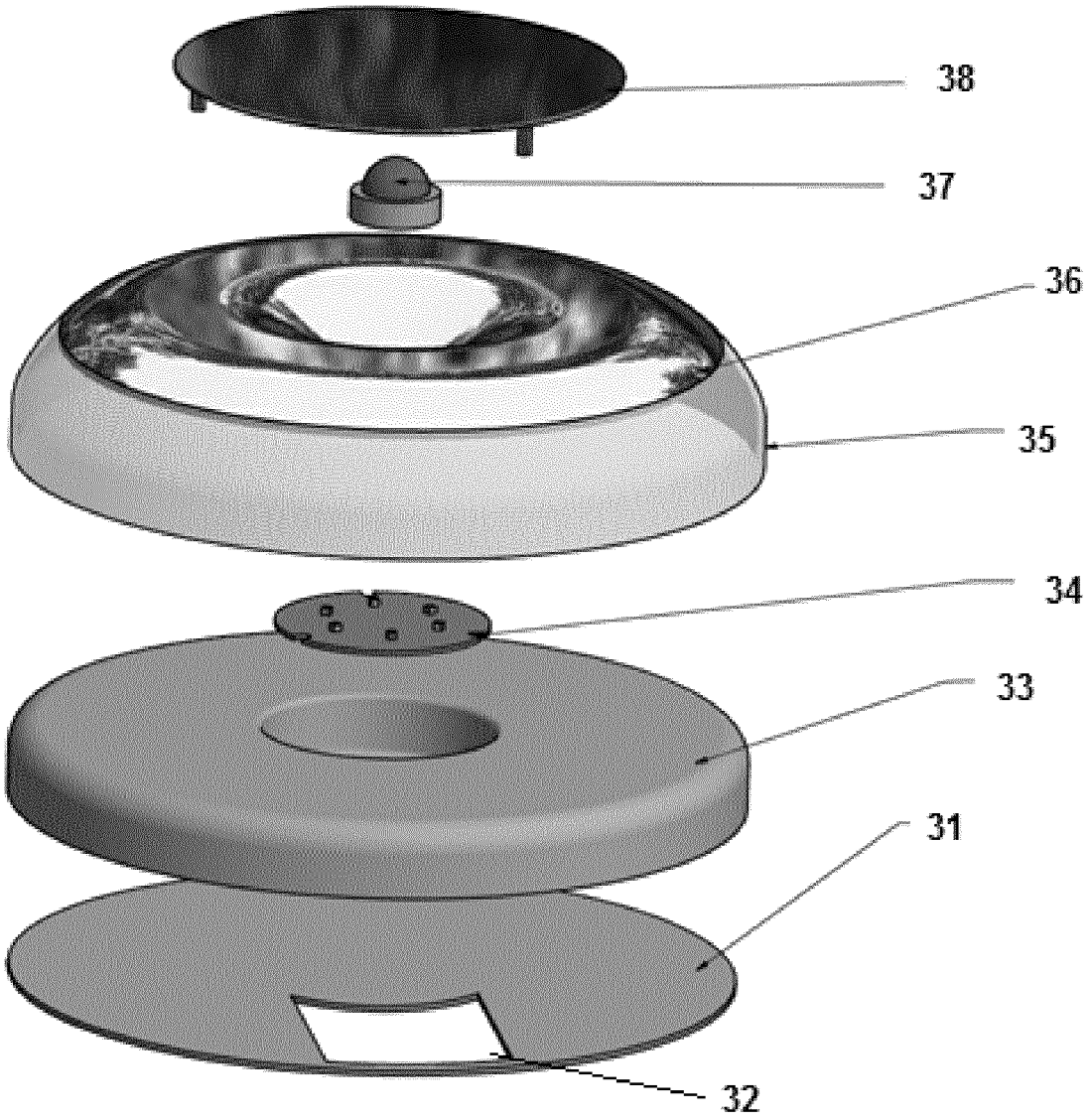
Figure 6:
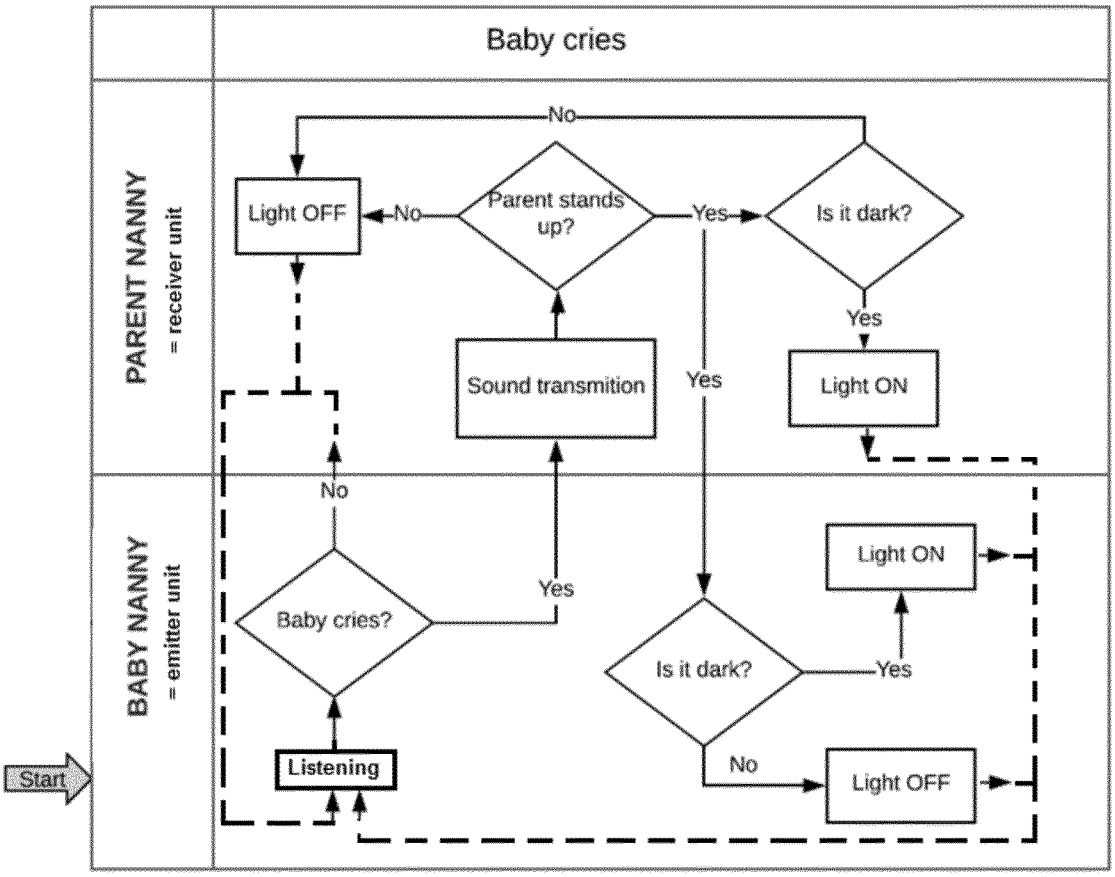
Figure 7:
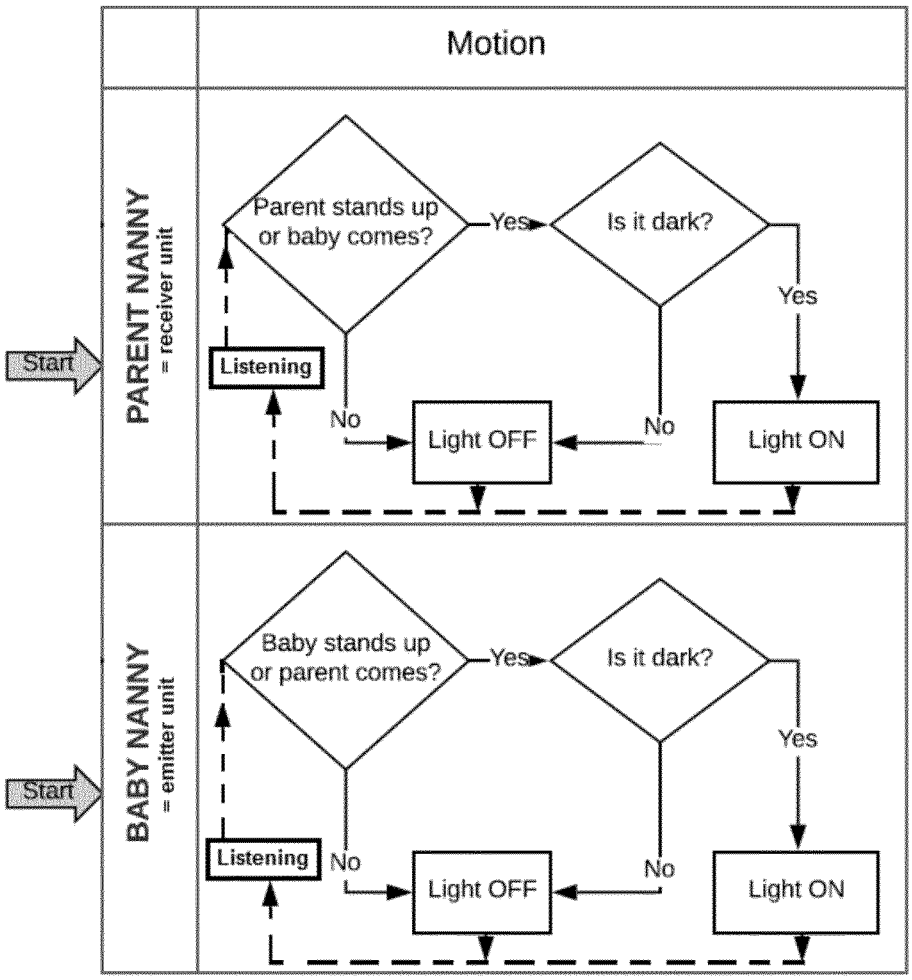

FIG. 1 presents top and side view of a first exemplary embodiment of the present invention, FIG. 2 presents perspective view of the embodiment shown in FIG. 1, FIG. 3 presents top and side view of a second exemplary embodiment of the present invention, FIG. 4 presents perspective view of a 3D model of the embodiment shown in FIG. 3, FIG. 5 presents an exploded view of a 3D model of the embodiment shown in FIG. 4, FIG. 6 presents an exemplary block diagram of a decision-tree of the baby monitor assembly, in a case when sound of a crying baby is detected, and FIG. 7 presents and exemplary block diagram of a decision-tree of the baby monitor assembly, in a case when motion is detected.

DETAILED DESCRIPTION OF THE INVENTION

Referring to FIG. 1 and FIG. 2, there is presented an exemplary embodiment of the construction of the units of the baby monitor assembly. Housing 10 of the units has a disc-like shape, that comprises generally two similar halves 11, 12, that are separated from each other and thus forming a small slit 13. Preferably, the two halves 11, 12 of the housing 10 are made of material that doesn't allow for the passage of light, e.g. metal, plastic, wood etc., or material like glass or transparent plastic that allows for the passage of light, but is covered with coating that doesn't allow for the passage of light. Between the two halves 11, 12 and within the small slit 13 there is provided a cylindrical wall 14 that allows for the passage of light, preferably made of a transparent or a perforated material, e.g. glass, plastic etc. The small slit 13 serves as a guide, that directs the light in parallel to the floor and prevents the light from shining directly or after reflecting from the floor into the user's eyes. Preferably, the surface of the two halves 11, 12 of the housing 10, that is between the cylindrical wall 14 inside the slit 13 and the external edge 15 of the two halves 11, 12, is covered with a coating that absorbs the light preventing unintended reflections, e.g. black paint, powdered graphite etc.

In one of the halves 11, 12, preferably in the halve that in normal operation is not in contact with the floor, called the 'upper' 11, there is provided an opening 16 for the charger, for example a USB-type port. Also, in the upper halve 11 of the housing 10 there are provided buttons 17 for operating the unit, for example a power button, a light-intensity button, a volume button, a light intensity sensor button, a light-color button, buttons for configuring specific type of operation (e.g. setting the device as the emitter unit or the receiver unit) etc. Some of these buttons 17 might be also realized as sliders, touch-pads etc. or some or all of the interactive parts might be realized as a single touch-pad or touch-screen.

Inside the housing 10 there are located means for sound detection, means for wireless communication, source(s) of light, optionally also any of the following: means for generating sound, means for generating vibrations, means for motion detection, means for heat detection, means for shaping beam of emitted light, means for providing power like a battery or a connection port and electrical means for configuring and managing the unit, for example a programmable logical system, e.g. a microcomputer, integrated circuit or PCB-based controller.

In exemplary embodiments of the present invention, the housing 10 can be described with following dimensions:

- outer diameter—ranging from 5 to 40 cm, preferably between 10 to 25 cm,
- height—ranging from 1 to 6 cm, preferably between 1, 5 to 4 cm,
- width of the small slit 13—from 1 to 9 mm, preferably between 3 to 6 mm.

With respect to the device shown in FIG. 1 and FIG. 2, the emitter unit and the receiver unit has housing 10 that has outer diameter of 20 cm, height of 2, 1 cm and its slit is 5 mm wide, with its upper and lower edge rounded.

Referring to FIGS. 3, 4 and 5, there is presented another embodiment of the construction of the units of the baby monitor assembly. The housing 30 is again generally flat and disc-like shaped, however in this embodiment the emitted light doesn't pass via the small slit, but through either a partly or fully transparent part of the housing.

Starting from the bottom part of the device—the unit comprises a flat, generally circular bottom cover 31. The bottom cover 31 can be provided with an opening 32, that can serve e.g. as an opening for accessing internals of the unit (e.g. to manually change setting of the unit) or even just as an opening for changing the batteries. In the embodiment presented in the FIG. 5 the opening 32 has two straight and two arched edges, but it should be understood that practically any shape of the opening is possible (circular, rectangular or polygonal), as long as it doesn't compromise the structural strength of the bottom cover 31.

Optionally, the bottom cover 31, from the side that is in contact with the floor, can be provided with gripping means, e.g. rubber protrusions, so that it doesn't slide easily on the floor.

Above the bottom cover 31 there is provided an internal housing 33, which has generally the same outer dimension as the bottom cover 31. Internal housing 33 has a disc-like shape, with generally flat surface that comes in contact with the bottom cover 31 around the units' periphery and rises above the bottom cover 31. The upper external edge of the internal housing 33 can be rounded.

The internal housing can have a lower cylindrical portion near its' center (central recess), so that it can provide a space suitable for inserting means for emitting light, e.g. a LED module 34 with several LED diodes.

In the ring-like part of the internal housing that is elevated above the bottom cover there is provided space for inserting internal components of the unit, such as power means (e.g. batteries), microphone, speaker, logic system etc.

The internal housing can be attached to the bottom cover by any known means, e.g. screws, clasps, glue.

Optionally, it can be provided with sealing means for protecting internal components from water, e.g. rubber seals, waterproof glue etc. In such case, the bottom cover and central recess of the internal housing should be also provided with sealing means.

The LED module 34 that fits within the central recess is preferably securely attached to the internal housing 33, so that it doesn't move around while the device is moved or carried—it can be assured by any known means, e.g. screws or clasps. The LED module 34 is provided with several diodes and these diodes are preferably equally spaced from the center and from each other. The number of diodes in the module can vary, but a single diode might not emit enough light or emit the light ununiformly, so that preferably there are several diodes in the module, e.g. three, four, five, six, seven, eight, nine etc.

Above the internal housing 33 and the LED module 34 there is an external housing 35, that has a dome-like shape with funnel-like recessed center. It is preferably made of partly or fully transparent material, e.g. transparent plastic. The upper part 36 of the external housing 35 (upper being the part that is above the internal housing 33 in the unit) and the funnel-like recess are preferably covered with a reflective coating, e.g. metalized. Such coating provides a mirror-effect for the light generated by the LED module 34 and thus guides the beams so that they leave the external housing 35 in parallel to the floor. To prevent shining directly into the eye of a user, the top surface of the internal housing 33 can be covered with a dark coating, e.g. black mat or graphite etc.

The shape of the funnel-like recess can be that of a focusing mirror, e.g. of an inclined arch revolved around the axis.

From the top side of the external housing 35 and above the funnel-like recess there is provided a sensor 37, preferably a motion sensor, e.g. a microwave motion sensor, that triggers the unit upon detecting movement.

Above the sensor 37 and supported by several legs there is provided the upper cover 38, that limits the field of view of the sensor 37, so that the sensor 37 can detect movement around the unit but not above it. The upper cover 38 therefore needs to be impervious or reflective for the signals that the sensor operates with, e.g. made of metal such as steel. The upper covers' legs rest on the top surface of the external housing 35 and can be connected thereto by any known means of screws, clasps, glue, a tight fit with complementary holes in the external cover, etc.

Parts of the unit of the baby monitor assemble such as bottom cover 31, internal housing 33, external housing 35 and base of the LED module 34 can be made of glass or plastic or, speaking about the parts that don't need to be transparent, also out of wood or metal. Parts can be made out of non-transparent materials or out of transparent materials covered with a type of coating, e.g. painted or metalized. In case the parts are made of plastic, they can be injection molded thus reducing costs of production.

Although the second embodiment presents no slit around its' periphery similar to the small slit 13 from the first embodiment, it should be noted that while comparing FIG. 3 and FIG. 5 it is easily visible, that there is a space between the upper part of the internal housing 33 and upper part 36 of external housing, that creates a slit which in assembled state is covered by the transparent part of external housing 35. Thus, one could say that a slit doesn't need to be visible/accessible from the outside, as long as it is present within the unit so that it can take part in guiding the emitted light.

The above-described unit can also be mounted to the bottom side of the baby's bed, hence can be equipped with conventional attaching means, such as grips, screws, bolts, adhesive tape etc.

Despite describing two types of the housing 10 and 30, it should be understood that other embodiments are also possible. In general, the housing can be flat so that in case of accidental stepping onto the unit the person won't get hurt by an edge or spike etc. However, the housing can be also dome-like shaped, or even can have a shape of a full or of a half of a polyhedron, preferably with rounded edges.

The above described shapes of the units' housing are disc-like, cylindrical and close to being axisymmetric. It should be understood, that the shape of the housing, as seen from above, can differ from axisymmetric, e.g. can be a polygon like a hexagon, an octagon, a decagon etc., or even a triangle.

The only requirement for the shape of the unit is that it has means, e.g. a small slit around its' periphery, so that it can emit light in parallel to the floor without shining it directly or by reflection from the floor into the users' eyes.

Referring to FIG. 6, there is presented an exemplary block diagram of how the baby monitor assembly reacts when triggered by sounds emitted by the baby.

The emitter unit, which is located near the baby, is provided with means for sound detection, such as a microphone. While the emitter unit is turned on, the microphone is preferably always 'listening'. When the microphone detects the sound, the emitter's logic system examines it according to predetermined set of rules, e.g. checks its frequency and/or amplitude, to determine if the sound originated from the baby or from any other source. If the emitter's logic determines, that the sound originated from the baby, the emitter powers up and proceeds along the path 'Yes', otherwise, the emitter returns to 'listening' mode, also called 'stand-by' mode throughout this application.

The logic system can compare the detected sound with a database of known sounds, to determine the source of the sound. If the sound is found to originate e.g. from a bus passing by, the door being locked or a dog barking in the street etc., namely—not from within the baby's room and especially was not generated by the baby—the emitter unit doesn't power up any further and returns to listening mode.

There are many other ways for the logic system to determine if the sound originated from the baby—e.g. instead of the database of sounds to compare with, the system can comprise an algorithm that mathematically checks if the detected sound fulfills requirements of predetermined mathematical equations, that describe most or even all of the possible sounds that can be generated by the baby, which can comprise sounds like the baby's cry, coughing, baby-chatter, baby's movements in the bed, sounds of baby's arms/legs/head impacting sides of the baby's bed etc.

It should be also understood, that although the units of the baby monitor assembly can comprise means for distinguishing sources of the detected sound, this is only a preferable option. In the most basic configuration, the units only check the volume of the detected sound, regardless of its' origin, and activate when the measured volume exceeds the predetermined value, which preferably can be adjusted to match different conditions of different flats and homes.

In case the emitter determines, that the sound originates/could originate from the baby, the emitter powers up and begins transmitting sounds to the receiver unit, located near the parent. Then, the receiver unit powers up, plays the sound received from the emitter unit and waits for the parent's reaction. If the receiver unit detects, that the parent is not going to go and check on the baby (e.g. by detecting movement near the floor), the receiver unit does nothing more. If the receiver unit detects, that the parent is going to check on the baby, the receiver unit checks the light intensity within its vicinity. If it detects that it is dark, e.g. by using the light intensity sensor and comparing it with the predetermined value that is considered to be 'dark', the receiver unit starts emitting light, especially in parallel to the floor. This helps the parent to find the path across the floor and go around any obstacles present on the floor.

Similar movement detection and powering up to emit light, selectively essentially in parallel to the floor, is carried out by the emitter unit. After transmitting sounds from the baby's room to the receiver unit, if the receiver unit started emitting light, the emitter unit also checks the intensity of light within its vicinity. If it detects, that it is not dark enough in the room (e.g. because the parents left the light on), it does not start emitting light, if it detects that it is dark—it starts emitting light. It can begin this action either after receiving information from the receiver unit, that the receiver unit started emitting light, or it can wait unit it detects movement in the baby's room (e.g. of the door opening or the parent walking into the room) and thus preserve energy.

The process of triggering the baby monitor assembly can be regulated by a predetermined set of rules that organizes how long certain actions/processes can last. They can also determine the time intervals between the assembly can be triggered again etc. For example, if the emitter unit detects the first sound/noise in the baby's room, it powers up and awaits the next sound/noise for a predetermined time, e.g. 30 seconds, preferably 10 seconds or less. If the emitter unit detects the next sound/noise within this time frame and that sound/noise fulfills predetermined requirements, the baby monitor assembly becomes triggered, otherwise it goes back to stand-by mode. Similarly, the sound transmission to the receiver unit without parent's reaction (without the parent going to the baby's room to check on it) can last a predetermined amount of time, e.g. 5 minutes, preferably 2 minutes or less. If within that time the parent doesn't react, it is a signal for the baby monitor assembly that emitting light will not be necessary and after the said time is over the baby monitor assembly stops transmitting sounds and goes into 'listening' mode. Optionally, powering down and going into stand-by mode can be initiated by the user (the parent), e.g. by pressing a button or even by a voice command.

Although, both the emitter unit and the receiver unit of the baby monitor assembly according to any embodiment of the present invention are provided with means for wireless communication, use cases in which the communication means do not have to be used are also foreseen. In such cases, the emitter unit and the receiver unit can serve as stand-alone devices, that do not communicate directly with each other. Example of such mode of operation is described below.

Referring to FIG. 7, it presents a block diagram similar to the one shown in FIG. 6, but simpler. Here the baby monitor assembly works in a way that uses less types of sensors per device (emitter unit, receiver unit) than the previously described embodiments and this mode of operation doesn't include interaction between the devices.

In the present embodiment of the invention, the emitter unit and receiver unit are in normal operation in a stand-by mode, and can be triggered by detecting that the parent or the baby is approaching. It can be realized preferably by using motion sensors, heat sensors or optionally sound sensors that could detect the sounds generated by a walking person or a moving baby. If the device is triggered, it checks if it is dark in its vicinity, e.g. by using light intensity sensor and comparing measured value with the predetermined value. If the device determines, that it is 'dark', it starts emitting light, otherwise—it does nothing and goes back to stand-by mode.

With respect to any embodiments of the present invention, the process of triggering the baby monitor assembly can be regulated by the predetermined set of rules that organizes how long certain actions/processes can last. These rules can determine for how long the device will be emitting light after being triggered, e.g. for 60 seconds, preferably 30 seconds or less. It can also determine if and how often the device, after being triggered, will check if emitting light is needed. For example, in a scenario when the parent has to change the baby's diaper, the parent might turn on the main light in the room and so—the light from the baby monitor assembly won't be needed for the time being. Therefore, both the emitter and the receiver unit can be set to, after being triggered, emit light for e.g. 45 seconds but after e.g. 35 seconds they can check whether there is still somebody walking near them or if it is dark in their vicinity or not. Mentioned time intervals can be set according to the need, but set values should generally include energy efficiency (so that the devices won't emit light when it is not needed) and personal safety (so that the device won't stop emitting light while a person is still walking near it). Alternatively, the baby monitor assembly can go back to stand-by mode as a result of the parent's action, e.g. pressing a button, gesture, voice command etc.

The device can be further provided with means for recognizing whether the detected movement is that of a baby/parent, or of an animal, so that if there is a cat, a dog, within the house or even just a bug flies near the device, it won't trigger. Such distinction can be realized by combining and/or programming motion and/or heat sensors, that will distinguish between the situation when the device should be triggered and when it shouldn't.

In some embodiments of the present invention, it might be possible to use more than two units to form the baby monitor assembly. For example, if the path from the parent's bed to the baby's room/crib would be long/full of turns, the two units might not emit enough light to illuminate all possible obstacles along the way. Thus, additional units might be added. These additional units might be configurable, to connect with the receiver unit, so that when the receiver unit would emit light, they would also activate to emit light. Such configuration could be chosen by the user, e.g. by pressing a button.

In some embodiments of the present invention, the receiver unit might be provided with a microphone and the emitter unit might be provided with a speaker. In such cases, the baby monitor assembly might use it's means for wireless communication to transmit voice of the parent to the baby to calm it down. This could be triggered by the parent's action, for example pressing a button, making a gesture, giving a voice command etc. Such embodiment could be especially helpful in cases when the baby is awakening and hearing the parent's voice will be enough for the baby to return to sleep, whereas going to the baby personally could lead to fully waking up the baby.

In some embodiments of the present invention, the emitter unit and the receiver unit of the baby monitor assembly can be identical in their construction and/or in their functionality. Preferably, in such cases the user would be able to configure which device would serve as the emitter unit and as the receiver unit.

In yet other embodiments of the present invention, the emitter unit is of the type described in the present application (generally flat, disc-like shape, that can emit light etc.), while the receiver unit is the user's electronic device, e.g. smartphone, computer, tablet etc. Such electronic devices provide even more possibilities to configure and personalize type of notifying the parent about detected noise and/or movement in the baby's room, e.g. by using complex sound alarms, vibrations etc. However, these complex electronic devices might emit too much light and therefore be less convenient for the use at night.

In some embodiments it is also possible to configure the baby monitor assembly, to establish another way of communication between the parent and the child, besides sounds. Both the emitter unit and the receiver units can be set to emit light upon being triggered without initializing transfer of sounds. One such configuration could be realized by detecting a predetermined action, e.g. sound or gesture, and upon detecting such action from the baby by the emitter unit, e.g. emitting light by the receiver unit near the parent. After that, if the receiver unit detects a predetermined action from the parent, e.g. a gesture, the emitter unit near the baby would notify the baby, e.g. by means of vibration or emitting light. This would mean for the baby, that the parent is nearby and alert, without further awakening the baby.

The invention claimed is:

1. A baby monitor assembly, comprising an emitter unit and a receiver unit, wherein the emitter unit comprises:

means for sound detection, means for communication with the receiver unit, a flat housing (10, 30), having a slit (13) near it's periphery, a source of light, wherein the receiver unit comprises:

means for communication with the emitter unit, signalizing means wherein the emitter unit is configured for placing under baby's crib or bed, and is capable of detecting sounds generated by the baby, and sending information to the receiver unit upon detection of predetermined type of noise, wherein the receiver unit is configured for receiving information from the emitter unit and notifying the parent by using light, sound or vibration signals, upon receiving information from the emitter unit, characterized in that the slit (13) in the emitter unit's housing (10, 30) allows for passage of light from the source of light located in the housing (10, 30), and is configured for emitting the light beam selectively essentially parallel to the floor, so that the light beam neither shines directly nor reflects into the eyes of the baby and the user.

2. The baby monitor assembly according to claim 1, characterized in that it is configured so that the emitter unit powers up upon first detection of a predetermined type of noise and waits for the second detection of the predetermined type of noise within a predetermined time interval from the first detection, and only upon such second detection within the predetermined time interval from first detection—the emitter unit sends information to the receiver unit to notify the parent and starts generating light through the slit (13).

3. The baby monitor assembly according to claim 1, characterized in that the emitter unit is provided with a filter of light to filter out spectrum of a blue light from the light it emits.

4. The baby monitor assembly according to claim 1, characterized in that the emitter unit further comprises attaching means for attaching the emitter unit to the underside of the bed/crib.

5. The baby monitor assembly according to claim 1, characterized in that the emitter unit is configured to gradually rise or reduce light intensity, according to user's preferences.

6. The baby monitor assembly according to claim 1, characterized in that inside the emitter unit there is a set of colorful light sources that can be programmed to emit light of a preferred color and/or with a preferred sequence.

7. The baby monitor assembly according to claim from 1, characterized in that the receiver unit has a speaker and the emitter unit is capable of transmitting sounds detected by the microphone to the receiver unit to be played by the receiver unit to the user.

8. The baby monitor assembly according to claim 1, characterized in that the receiver unit is further provided with sound recording means, and the receiver unit is configured for transmitting sounds recorded by the receiver unit's sound recording means to the emitter unit, and the emitter unit is further provided with a speaker and is configured for emitting sounds received from the receiver unit.

9. The baby monitor assembly according to claim 8, characterized in that the receiver unit is configured such that transmission of sound from the receiver unit to the emitter unit occurs only upon user direct interaction with the receiver unit.

10. The baby monitor assembly according to claim 1, characterized in that the emitter unit further comprises a motion sensor (37) and/or a light intensity sensor.

11. The baby monitor assembly according to claim 1, characterized in that the emitter unit and/or the receiver unit are provided with internal power source or with socket for connecting to an external power source, or with both the internal power source and socket for connecting to the external power source.

12. The baby monitor assembly according to claim 1, characterized in that the housing (10, 30) of the emitter unit and/or of the receiver unit has a disk-like shape, with flat top and bottom surfaces.

13. The baby monitor assembly according to claim 1, characterized in that a single lens or a set of lenses is located in the housing (10, 30) for shaping the light beam.

14. The baby monitor assembly according to claim 1, characterized in that the emitter unit and the receiver unit are identical devices.

15. The baby monitor assembly according to claim 1, characterized in that the receiver unit is a smartphone or a tablet.

* * * * *